United States Patent [19]

Shimizu

[11] Patent Number: 4,754,444

[45] Date of Patent: Jun. 28, 1988

[54] ALARM CLOCK

[75] Inventor: Sadao Shimizu, Saitama, Japan

[73] Assignee: Rhythm Watch Co., Ltd., Tokyo, Japan

[21] Appl. No.: 119,642

[22] Filed: Nov. 12, 1987

[30] Foreign Application Priority Data

Nov. 26, 1986 [JP] Japan ..... 61-181285[U]
Nov. 27, 1986 [JP] Japan ..... 61-183266[U]

[51] Int. Cl.[4] ..... G04B 23/02; G04B 37/00

[52] U.S. Cl. ..... 368/72; 368/88; 368/250

[58] Field of Search ..... 368/72–74, 368/88, 243, 244, 250, 98, 109

[56] References Cited

U.S. PATENT DOCUMENTS

| | | | |
|---|---|---|---|
| 2,008,745 | 7/1935 | Carlson et al. | 368/250 |
| 2,554,809 | 5/1951 | Bourquin | 368/72 |
| 3,175,352 | 3/1965 | Albinger, Jr. | 368/244 |
| 3,328,952 | 7/1967 | Clark | 368/244 |
| 3,407,402 | 10/1968 | Morrison et al. | 368/250 |

FOREIGN PATENT DOCUMENTS

| | | | |
|---|---|---|---|
| 1344425 | 10/1962 | France | 368/250 |

*Primary Examiner*—Vit W. Miska
*Attorney, Agent, or Firm*—Koda and Androlia

[57] ABSTRACT

There is disclosed an alarm clock comprising a vertical mounting plate having an integral battery case at its bottom, the battery case being inwardly rounded to receive a battery therein, a motor mounted to the mounting plate upwardly of and closely to the battery case and electrically connected to the battery, the motor including an output shaft extending parallel to the plane of the mounting plate, a clockwork mechanism fixedly mounted to the mounting plate forwardly of and closely to the motor and the battery case, a gong mounted to the mounting plate upwardly of and closely to the motor, an alarm hammer unit driven by the motor and having an alarm hammer positioned wthin the gong and swung to strike the gong upon actuation of the motor, and an operating lever surrounded by the motor, the clockwork mechanism and the battery case and reciprocable on the mounting plate in the longitudinal direction of the battery case. This arrangement is intended to reduce the overall thickness of the alarm clock as well as the space required to mount the components on the mounting plate.

2 Claims, 4 Drawing Sheets

ALARM CLOCK

BACKGROUND OF THE INVENTION

1. Field of the Invention

The present invention relates to an alarm clock.

2. Description of the Related Art

There has recently been proposed an alarm clock with an alarm hammer unit driven by a motor to strike a gong. Such alarm clock is disclosed, for instance, in Japanese Utility Model Laid-Open Publications No. 55-32449 and No. 55-46240. The disclosed alarm clock typically includes a clockwork mechanism, a battery and an alarm hammer unit driven by a motor and having a alarm hammer swingable to strike a gong. The gong is located behind the clockwork mechanism to provide larger alarm sound, However, all the components are located on one side of the mounting plate in a flatwise fashion. This arrangement consumes a greater space and consequently, the size of the alarm clock increases. In addition, the output shaft of the motor extends vertically to the plane of the mounting plate, and this results in an increase in the overall thickness of the alarm clock.

SUMMARY OF THE INVENTION

It is, therefore, an object of the present invention to provide an alarm clock which is small in size and compact in structure.

According to one feature of the invention, there is provided an alarm clock comprising a vertical mounting plate having an integral battery case at its bottom, said battery case being inwardly rounded to receive a bettery therein, a motor mounted to said mounting plate upwardly of and closely to said battery case and electrically connected to said battery, said motor including an output shaft extending parallel to the plane of said mounting plate, a clockwork mechanism fixedly mounted to said mounting plate forwardly of and closely to said motor and said battery case, a gong mounted to said mounting plate upwardly of and closely to said motor, and an alarm hammer unit driven by said motor and having an alarm hammer positioned within said gong and swung to strike said gong upon actuation of the motor.

The motor has an output shaft extending parallel to the plane of the vertical mounting plate. This results in a substantial reduction in the overall thickness of the alarm clock. The clockwork mechanism is placed closely to the upper surface of each of the motor and the battery case or battery. This enables compact arrangement of the alarm clock.

According to another feature of the invention, there is provided an alarm clock comprising a vertical mounting plate having an integral battery case at its bottom, said battery case being inwardly rounded to receive a battery therein, a motor mounted to said mounting plate upwardly of and closely to said battery case and electrically connected to said battery, said motor including an output shaft extending parallel to the plane of said mounting plate, a clockwork mechanism fixedly mounted to said mounting plate forwardly of and closely to said motor and said battery case, a gong mounted to said mounting plate upwardly of and closely to said motor, and an alarm hammer unit driven by said motor and having an alarm hammer positioned within said gong and swung to strike said gong upon actuation of said motor, an operating lever surrounded by said motor, said clockwork mechanism and said battery case and reciprocable on said mounting plate in the longitudinal direction of said battery case, and means for holding said operating lever alternately at on and off positions.

The motor has a gong holder immediately above the motor to hold a gong. The motor is, thus, surrounded by the gong holder, battery case and clockwork mechanism and is prevented from being damaged when the alarm clock is accidentally dropped.

The foregoing and other objects, features, and advantages of the present invention will be more apparent from the following detailed description, when taken in connection with the accompanying drawings.

PREFERRED EMBODIMENTS OF THE INVENTION

Figure 1:
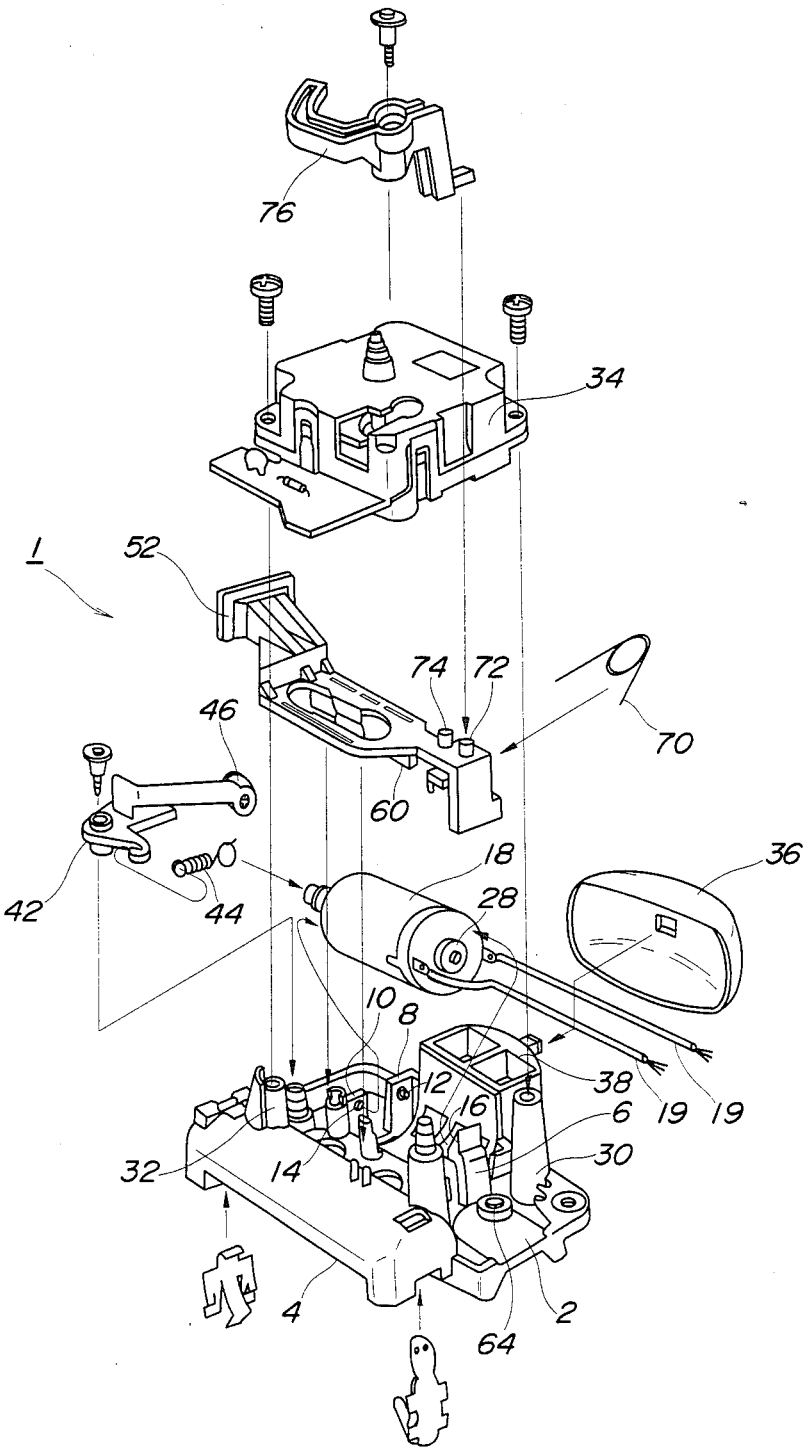
FIG. 1 is an exploded perspective view of an alarm clock with a clock cover removed for clarity, according to a preferred embodiment of the present invention.

FIGS. 1 to 4 show an alarm clock generally designated by reference numeral 1. The alarm clock 1 has a vertical mounting plate 2 at its rear side. The mounting plate 2 has an inwardly rounded integral battery case 4 at its bottom for receiving a bettery 5 therein.

Figure 2:
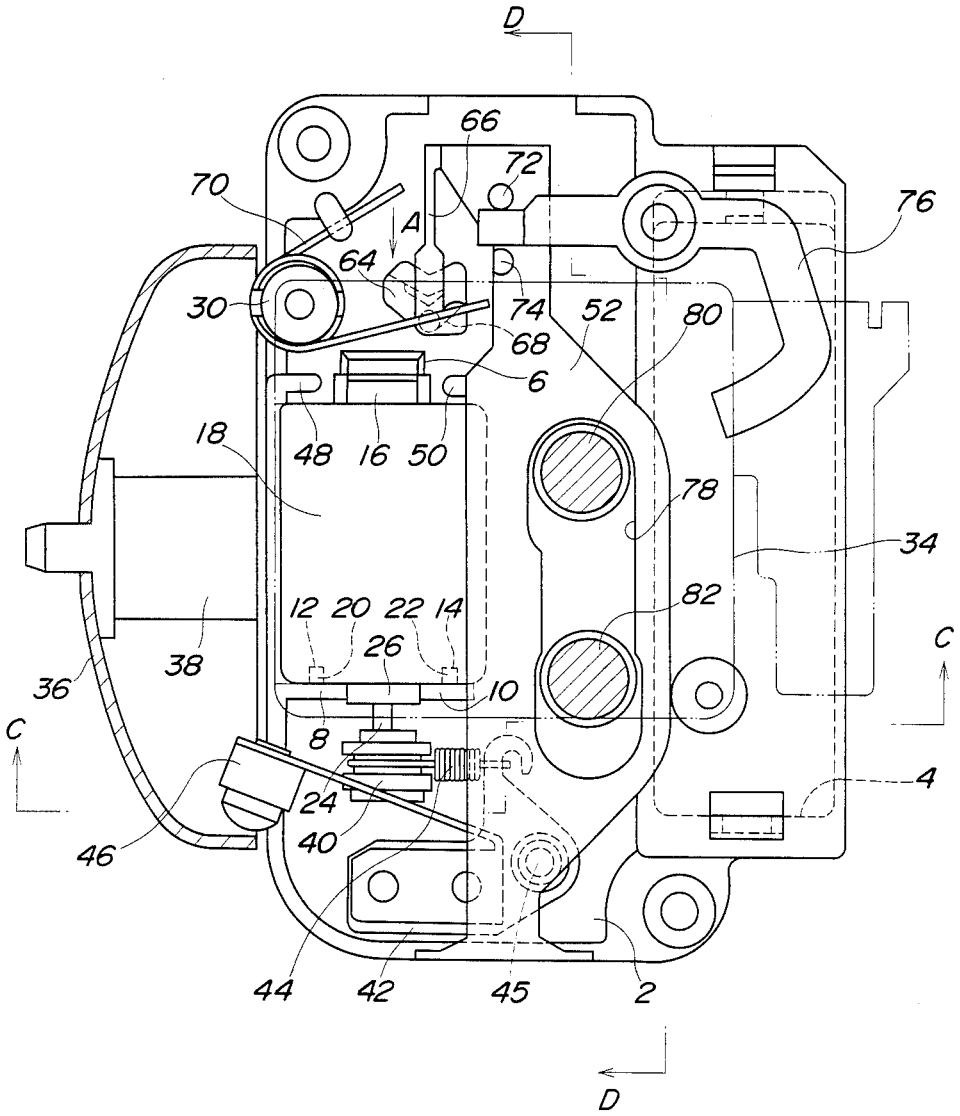
FIG. 2 is a top plan view, partly sectioned, of the alarm clock shown in FIG. 2.
Figure 3:
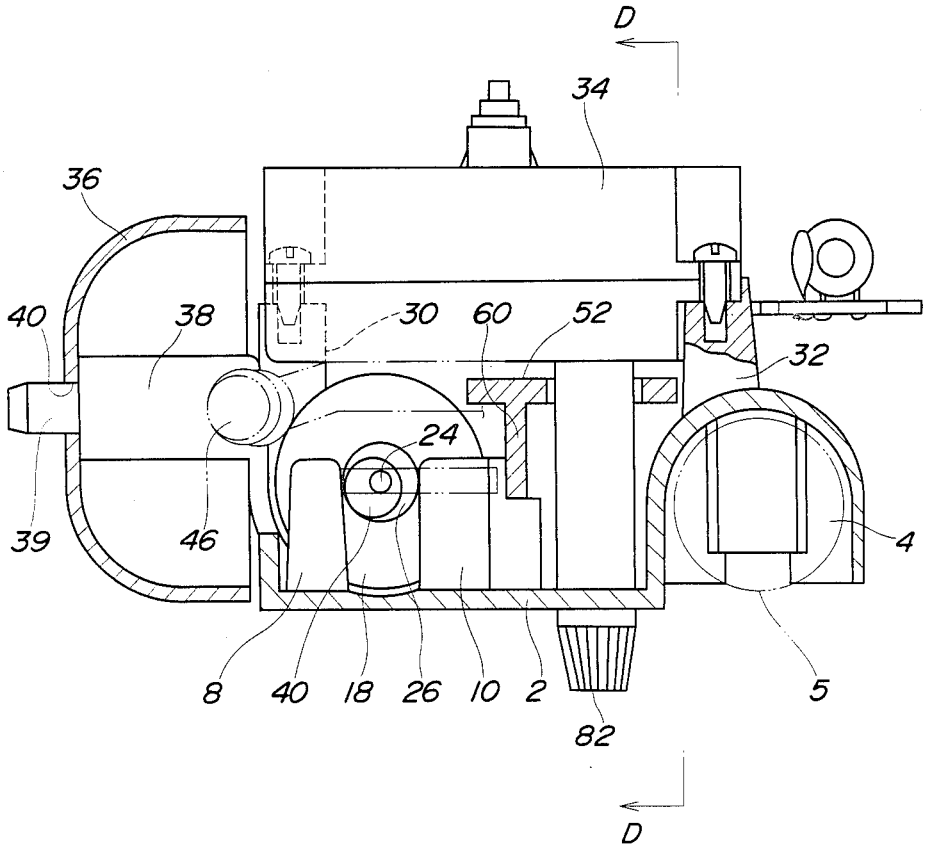
FIG. 3 is a sectional view taken along the line C—C of FIG. 2.

A deformable resilient pawl 6 and two upright walls 8, 10 are placed in confronting relation to one another on the mounting plate 2, the upright walls 8, 10 extending parallel to one another. As shown in FIG. 2, the upright walls 8, 10 have projections 12, 14 for engagement with corresponding holes 20, 22 formed at the front end of a motor 18. The resilient pawl 6 has a slant surface 16 in confronting relation to the upright walls 8, 10. Upon engagement of a bearing 28 of the motor 18 with the pawl 6, the slant surface 16 will fascilitate mounting of the motor 18 between the upright walls 8, 10 and the pawl 6. The motor 6 is electrically connected to the battery 5 through electric wires 19, 19. As best seen in FIG. 3, the motor 18 is located on the opposite side of the battery 5, but is arranged vertically of and closely to the battery case 4 or battery 5 with its thickness being equal to that of the battery case 4.

As shown in FIGS. 1 and 3, a clockwork mechanism 34 is bolted to two columns 30, 32 on the mounting plate 2, the clockwork mechanism 34 being situated forwardly of and closely to the motor case 4 and the motor 18. It will be understood that the clockwork mechanism 34 may be connected to the mounting plate 2 by the use of conventional resilient pawls.

The mounting plate 2 has at its top an integral gong holder 38 situated immediately above the motor 18. The gong holder 38 has a projection 39 into which a gong 36 is fitted through a hole 40.

As shown in FIG. 2, the motor 18 has an output shaft 24 extending parallel to the plane of the mounting plate 2. An eccentric cam 40 is mounted to the output shaft 24 of the motor 18. An alarm hammer unit 42 is connected through a coil spring 44 to the cam 40 and is swingable with respect to a pin 45 on the mounting plate 2. The alarm hammer unit 42 includes an alarm hammer 46 placed within the gong 36 and swung to strike the gong 36 upon actuation of the motor 18.

In FIG. 2, auxiliary columns 48, 50 are spaced from the motor 18 to prevent damage to the resilient pawl 6 due to shacks in the axial direction of the output shaft 24 (for instance, when the alarm clock is accidentally dropped).

Figure 4:
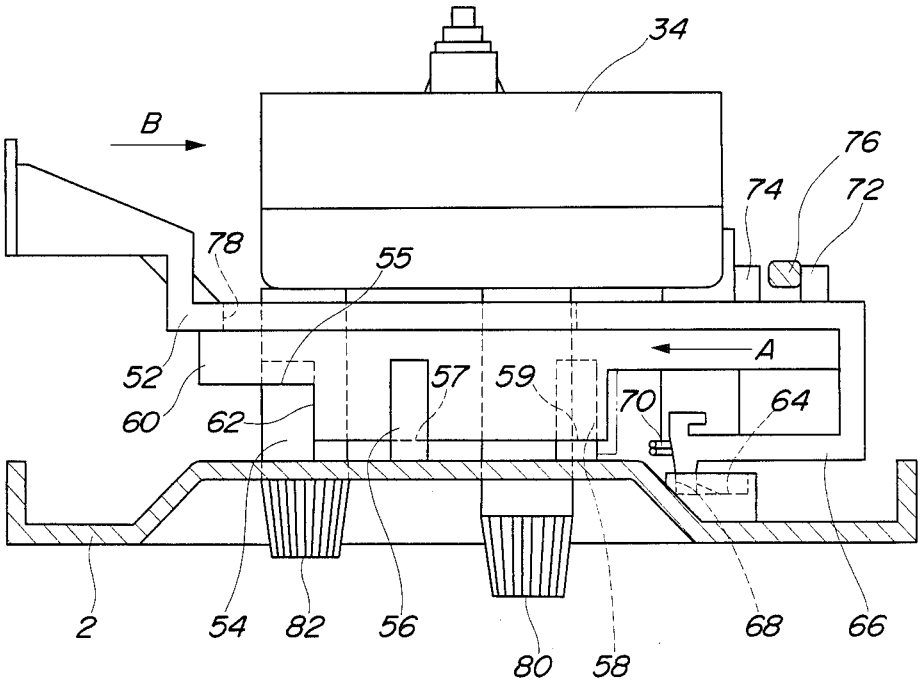
FIG. 4 is a sectional view taken along the line D—D of FIGS. 2 and 3.

As shown in FIG. 3, an operating lever 52, as an on/off switch, is mounted to the mounting plate 2 and surrounded by the battery case 4, the motor 18 and the clockwork mechanism 34. In order to ensure reciprocating movement of the operating lever 52, there is provided three guide columns 54, 56, 58 on the mounting plate 2 between the battery case 4 and the motor 18 as best seen in FIG. 4. The guide columns 54 and 58 have walls closely to the motor 18 while the guide column 56 has a wall closely to the battery case 4. A slide plate 60 extends vertically from the operating lever 5 and is inserted between the two guide columns 54, 58 and the guide column 56. The slide plate 60 has a contact surface 62, and the guide column 54 has a step surface 55 positioned upwardly of step surfaces 57 and 59 of the guide members 56, 58. Thus, movement of the operating lever 52 is limited when the contact surface 62 of the slide plate 60 comes into contact with the guide column 54.

There is also provided means for ensuring on and off positions of the operating lever 52. As shown in FIGS. 2 and 4, this means includes a deformable resilient arm 66 extending from the operating lever 52 and having at its forward end a projection 68 for engagement with a heart-shaped cam groove 64, and a return element 70 adapted to urge the arm 66 in the direction of the arrow A. Every time the operating lever 52 is pushed in the direction of the arrow B, the projection 68 slides in a predetermined direction in the cam groove 64 to bring the operating lever into the on and off positions alternately. A swing lever 76 is swingably supported at the mounting plate 2 and has one end inserted between pins 72 and 74 projecting from the operating lever 52. Upon movement of the operating lever 52, the swing lever 76 is swung to actuate a swich (not shown) for the motor 18 with its other end. The operating lever 52 has an elongated bore 78 through which a time setting knob 80 and a hand correcting knob extend.

While a preferred embodiment has been shown in the invention and described herein, it is not intended to limit the invention by such disclosure, but rather, it is intended to cover all modifications and alternative arrangement coming within the spirit and scope of the invention.

What is claimed is:

1. An alarm clock comprising:

a vertical mounting plate having an integral battery case at its bottom, said battery case being inwardly rounded to receive a battery therein;

a motor mounted to said mounting plate upwardly of and closely to said battery case and electrically connected to said battery, said motor including an output shaft extending parallel to the plane of said mounting plate;

a clockwork mechanism fixedly mounted to said mounting plate forwardly of and closely to said motor and said battery case;

a gong mounted to said mounting plate upwardly of and closely to said motor; and an alarm hammer unit driven by said motor and having an alarm hammer positioned within said gong and swung to strike said gong upon actuation of said motor.

2. An alarm clock comprising:

a vertical mounting plate having an integral battery case at its bottom, said battery case being inwardly rounded to receive a battery therein;

a motor mounted to said mounting plate upwardly of and closely to said battery case and electrically connected to said battery, said motor including an output shaft extending parallel to the plane of said mounting plate;

a clockwork mechanism fixedly mounted to said mounting plate forwardly of and closely to said motor and said battery case;

a gong mounted to said mounting plate upwardly of and closely to said motor;

an alarm hammer unit driven by said motor and having an alarm hammer positioned within said gong and swung to strike said gong upon actuation of said motor;

an operating lever surrounded by said motor, said clockwork mechanism and said battery case and reciprocable on said mounting plate in the longitudinal direction of said battery case; and means for holding said operating lever alternately at its on and off positions.

* * * * *